United States Patent [19]

Graf

[11] Patent Number: 5,062,601

[45] Date of Patent: Nov. 5, 1991

[54] MILL SCREEN APPARATUS

[75] Inventor: Carl R. Graf, King of Prussia, Pa.

[73] Assignee: Pennsylvania Crusher Corporation, Broomall, Pa.

[21] Appl. No.: 573,696

[22] Filed: Aug. 28, 1990

Related U.S. Application Data

[63] Continuation of Ser. No. 410,140, Sep. 21, 1989, abandoned, which is a continuation of Ser. No. 198,027, May 24, 1988, abandoned.

[51] Int. Cl.[5] ..... B02C 17/18

[52] U.S. Cl. ..... 241/79.3; 241/171; 241/178; 241/180

[58] Field of Search ..... 241/171, 172, 176, 177, 241/178, 179, 79.3, 79.2, 80, 97, 180, 299, 24

[56] References Cited

U.S. PATENT DOCUMENTS

| | | | |
|---|---|---|---|
| 787,885 | 4/1905 | Acklin | 241/79.3 |
| 1,575,719 | 3/1926 | Sandberg . | |
| 2,456,266 | 12/1948 | Gates . | |
| 2,480,085 | 8/1949 | Mitchell . | |
| 3,862,719 | 1/1975 | Muller . | |
| 4,013,233 | 3/1977 | Nylund . | |

FOREIGN PATENT DOCUMENTS

| | | | |
|---|---|---|---|
| 518734 | 4/1953 | France | 241/79.2 |

OTHER PUBLICATIONS

Chemical Engineers' Handbook, Perry, John H., McGraw-Hill, 1950, 3rd Edition, pp. 956–958.

*Primary Examiner*—Mark Rosenbaum

*Attorney, Agent, or Firm*—Pollock, Vande Sande & Priddy

[57] ABSTRACT

Apparatus for reducing and sizing particle material that is readily susceptible to efficiency enhancement with vibratory exciters. The apparatus includes a rotary drum particle size reductino device having a substantially imperforate drum, and a rotary screen having a perforate screening member with upstream and downstream portions, said upstream portion of the screen surrounding at least a portion of the periphery of the drum. A screen supporting member including a vibratory exciter engages an upstream portion of the screen for vibrating said upstream portion substantially independently of the drum.

25 Claims, 5 Drawing Sheets

FIG. 7
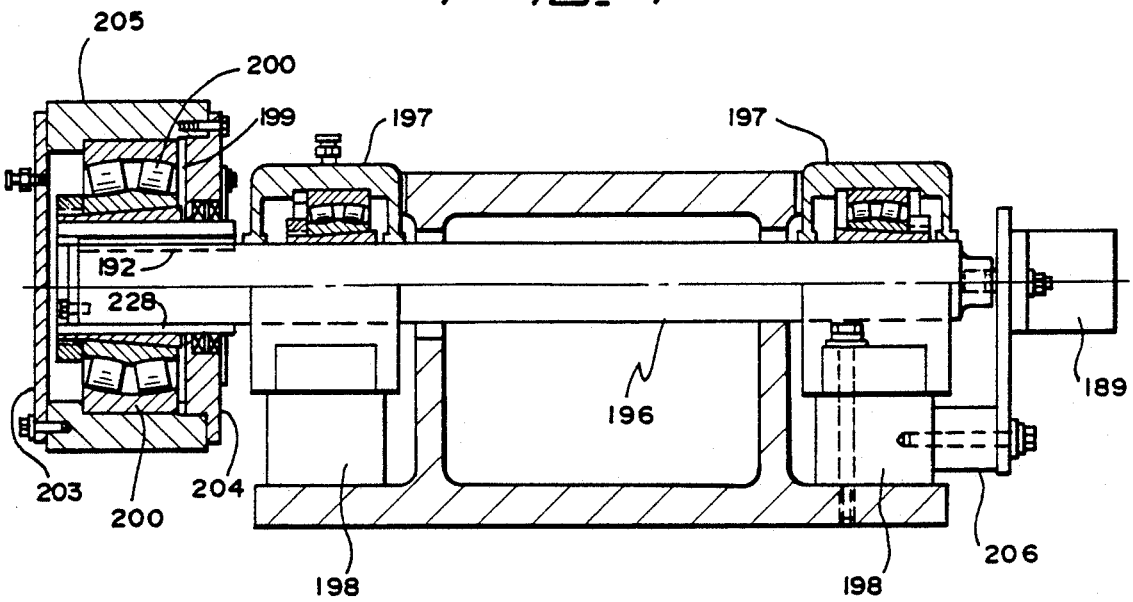
FIG. 8
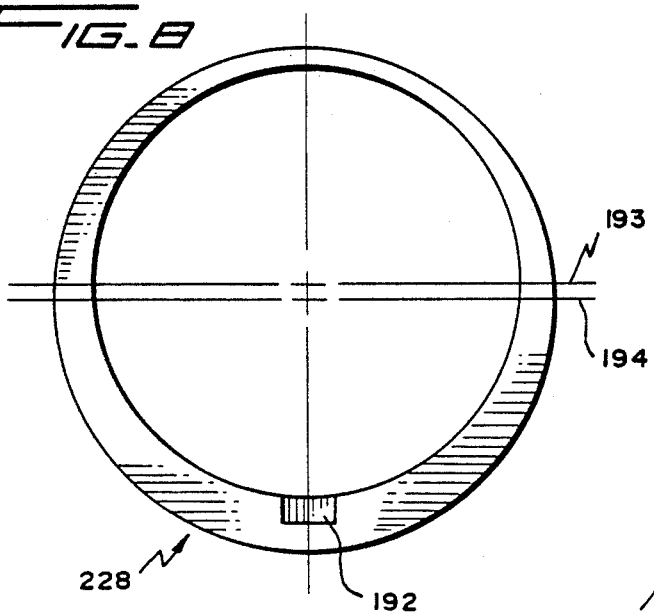
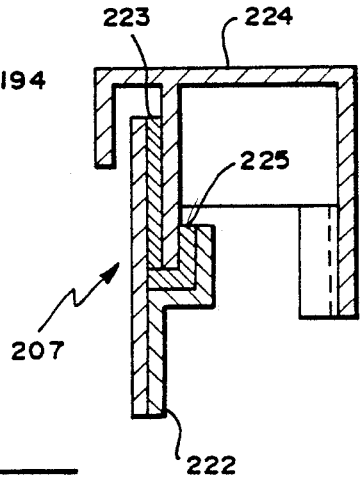
FIG. 9

MILL SCREEN APPARATUS

REFERENCE TO RELATED APPLICATIONS

This application is a continuation in part of U.S. patent application Ser. No. 07/410,140, filed Sept. 21, 1989, now abandoned which is a continuation of application Ser. No. 198,027, filed May 24, 1988, now abandoned for Mill Screen Apparatus, the disclosures of said applications being incorporated herein by reference.

TECHNICAL FIELD

The present invention relates to apparatus for particle size reduction. More particularly the invention relates to apparatus for reducing and sizing particulate material.

BACKGROUND

It has been suggested, for example in U.S. Pat. No. 2,480,085 dated Aug. 23, 1949 to George J. Mitchell, that a rotary ball mill be combined with a surrounding, concentric, co-rotating screen. In such apparatus, milled product containing solid particles above and below the product size specification can be delivered directly from the mill into the screen, and screened material can be recycled to the mill.

This general approach holds promise, at least theoretically, because such delivery and recycling can be performed without the necessity of using conveyors. Thus, substantial capital and operating cost savings as well as compact installations appear possible.

However, it is believed that there is a need to render the screen portions of such combinations more productive. It is known to employ vibratory devices to improve the productive capacity of some kinds of "stand-alone" screens, i.e. particularly those flat or curved but non-cylindrical screens that are not combined with mills. The purpose of the present invention is to provide rotary drum particle size reduction equipment combined with a co-rotating screen that at least partially surrounds the drum and that is readily susceptible to efficiency enhancement with vibratory exciters.

SUMMARY OF THE INVENTION

The invention includes co-rotating screen and reduction drum apparatus for reducing particulate materials, comprising: rotary drum particle size reduction means having a substantially imperforate drum; a rotary screen connected with said drum for co-rotation therewith, and having a perforate screening member with upstream and downstream portions, including upstream and downstream ends, said upstream portion of the screen surrounding at least a portion of the periphery of the drum; and means engaging an upstream portion of said screen and including a vibratory exciter for vibrating said upstream portion substantially independent of the drum, for restricting consumption of power that would otherwise be expended in vibrating the drum while promoting increased removal of fines from the particulate material through the upstream portion of the screening member.

One or more of the following advantages inhere in the various embodiments of the invention. Efficient use of the available power in the vibratory excitor is promoted, because consumption of that power in vibrating of the drum is at least restricted, if not substantially eliminated. Also, because the available power is applied in the upstream portion of the screen, where the population of fines in the material on the screen will ordinarily be at its highest level, it is possible to produce a high, early removal of fines from that material, thus promoting efficient utilization of the length of the screen. If the throughput capacity of the combination of drum and screen is thus rendered less dependent on screen length, the screen can be shortened sufficiently for convenient mounting in the space between the drum supports.

To the extent that screen blinding results from arching of particles across screen openings, vibration of the screen throughout its diameter, including that portion of the screening member which is passing through its apex of rotation at any given moment, shakes the arches of bridged particles while they are upside down and in an unstable condition which promotes breaking of the arches. Moreover, in this position, the effect of gravity assists the action of the exciter in shaking bridged and unbridged material free of the screen.

Because of the contribution(s) accruing from availability of one or more of these benefits in mill-screen combinations constructed according to the invention, enhanced screening efficiency can be realized when operating upon those materials that have heretofore proven difficult if not practically impossible to screen on trommel screens. An example of such a material could for example be material that is not fairly dry but must be screened to product with particle size specifications of approximately ¼ inch. Another example of such a material could for example be material that is not bone dry but must be screened to product with particle size specifications of approximately 1/16 inch. The apparatus of the invention therefore tends toward enhanced tolerance of varying moisture content in the feed material.

Other advantages of the invention will be evident to those skilled in the art upon acquiring experience in the construction and operation of its various embodiments.

This invention and further improvements thereon, the latter being both embodiments of the present invention and inventions in their own right, are illustrated and described in the accompanying drawings and in the text entitled "Various and Preferred Embodiments" which follows.

BRIEF DESCRIPTION OF THE DRAWINGS

FIG. 3 is another cross-section, also taken transverse to the longitudinal axis of the device, but at section line 3—3 in FIG. 1, and shows a broken out portion of the perforate screening member, shows supporting means for the screen and, in phantom lines, shows arcuate scoop members positioned for gathering material from the surface of the screen and connected with one or more ports formed in a peripheral wall of the drum.

FIG. 7 is a cross-sectional view of the screen vibrating mass at section line 7—7 of FIG. 6.

FIG. 8 is a cross-sectional view of the eccentric sleeve for the vibrating mass of FIG. 7.

VARIOUS AND PREFERRED EMBODIMENTS

Figure 1:
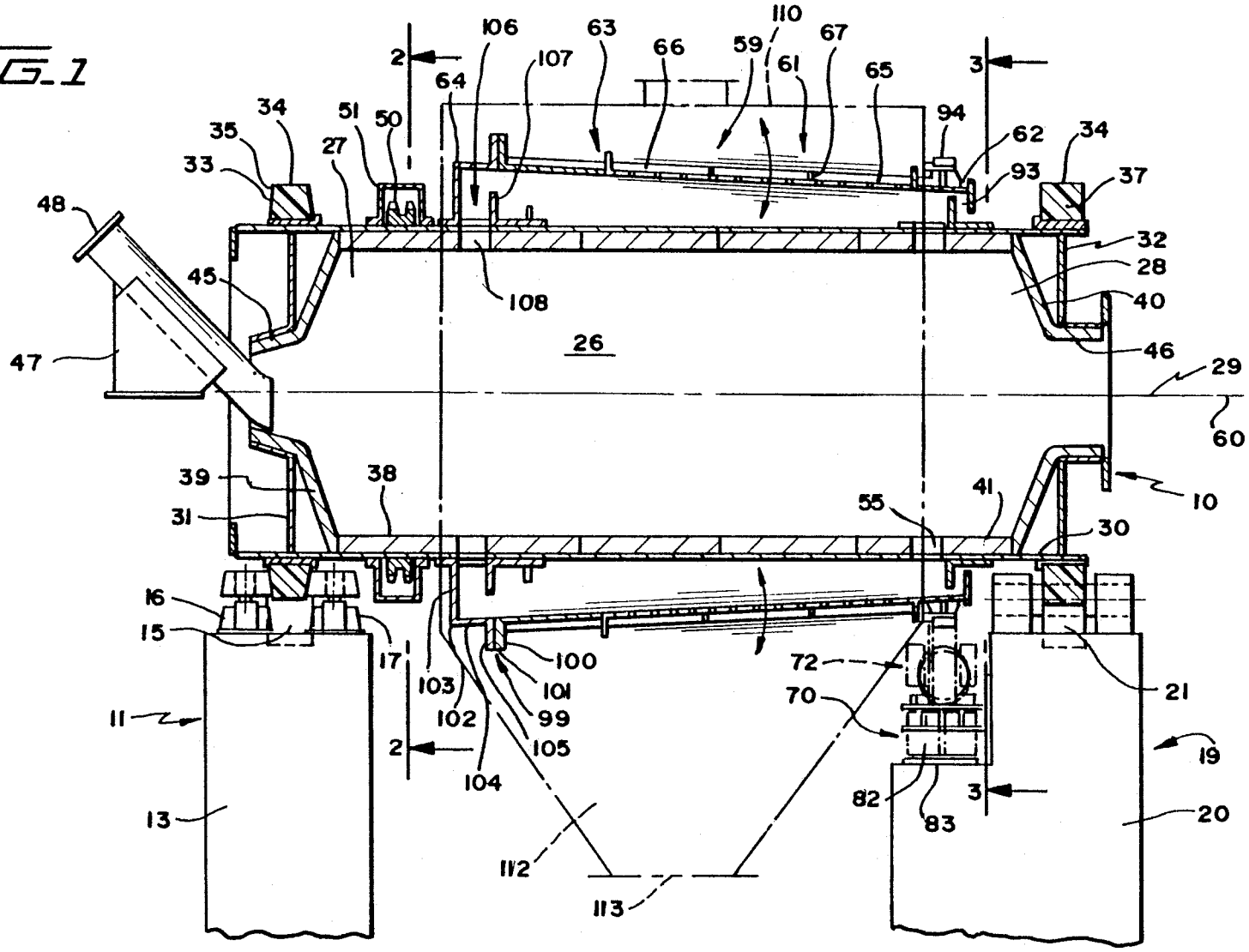
FIG. 1 is a vertical cross-section of a mill-screen according to the invention, including the longitudinal axis of the device, in which a housing or enclosure for the screen is shown in phantom outline.
Figure 9:
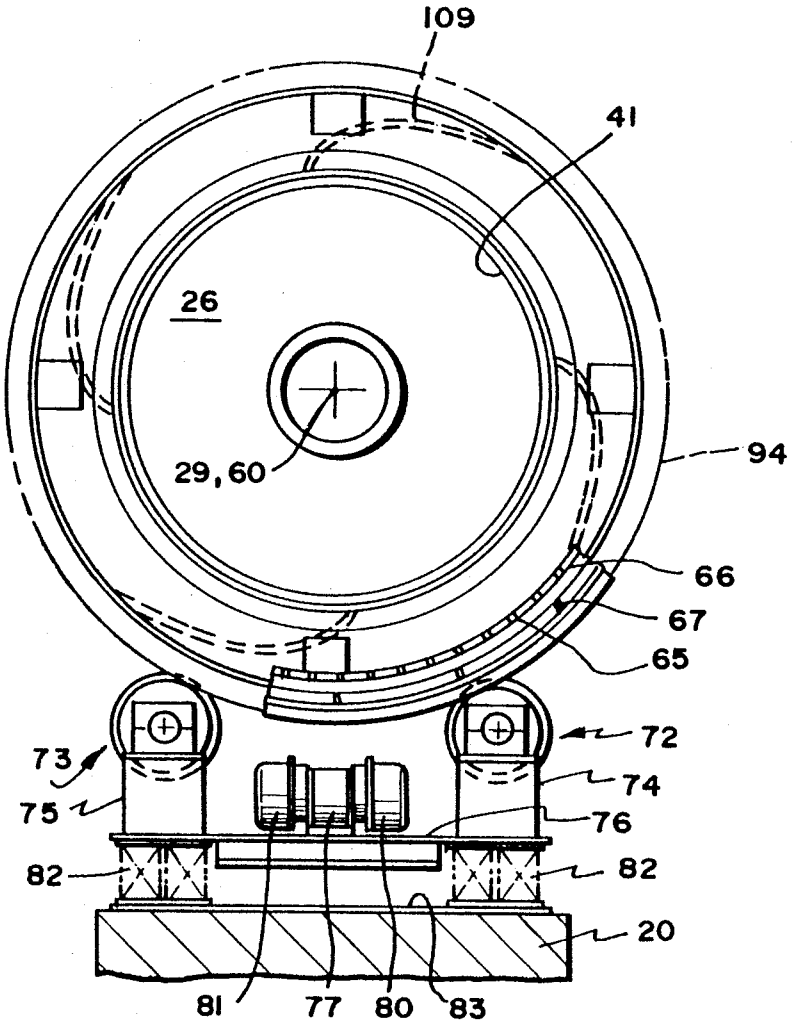
FIG. 9 is an enlarged cross-sectional view of the resilient joint between the screen and drum shown in FIG. 4.

Each of the following embodiments may be used singly or in any combination with the subject matter described above under "Summary of the Invention."

For example, one improvement upon the invention is an apparatus wherein the drum includes means for discharging particulate material that has been reduced in the drum into the upstream portion of the screening member. According to still another improvement which is a preferred embodiment of the one just described, the means for discharging particulate material includes one or more ports formed in a peripheral wall of the drum.

According to another improvement and preferred embodiment, the means connected with the upstream portion of the screen for vibrating its upstream portion substantially independent of the drum is effectively vibrationally isolated from the portion of the drum surrounded thereby. Alternatively, or in combination with the foregoing, the means for vibrating predominantly produces vibrational components in the screen in directions transverse to the axis of rotation of the screen.

A variety of screen supporting arrangements are possible, and only a few preferred alternatives will be described herein. For example, the apparatus may include screen supporting means independent of the drum which engages the screen for supporting the upstream portion of the screen, and the means for vibrating may be included in said screen supporting means. In one preferred sub-category of devices as described above, the screen supporting means includes a tire on the upstream portion of the screen, wheels supportingly engaging said tire, and a wheel support for said wheels, and the means for vibrating is connected with said wheel support. Particularly preferred species within this sub-category are those in which the screen supporting means includes a tire on the upstream portion of the screen, wheels engaging said tire, a wheel support for said wheels, and wherein the means for vibrating is included in said wheel support. Other particularly preferred species within this sub-category are those in which the upstream portion of the screen is spaced inwardly in the longitudinal direction from the corresponding end of the drum, screen supporting means independent of the drum engages the screen for supporting the upstream portion of the screen, and drum supporting means, separate from the screen supporting means, for supporting said corresponding end of the drum, is spaced outwardly in the longitudinal direction from the corresponding end of the screen. It is preferred but not essential that the screen supporting means engage the screen at its upstream end.

Among the improvements and preferred embodiments of the invention are various spatial relationships of the various components of the device which are apparent from the drawings and/or written description herein. For example, it is preferred that the downstream portion of the screen surround at least a portion of the periphery of the drum. The length of the screen is preferably less than the length of the drum, and at least the upstream portion of the screen is spaced inwardly in the longitudinal direction from the corresponding end of the drum. More preferably, the entire screen surrounds at least a portion of the periphery of the drum.

According to the invention, the downstream portion of the screen preferably has a driving connection with the exterior of a peripheral wall of the drum for causing rotation of the screen as the drum rotates. Still more preferably, the downstream portion of the screen is both supported and driven by its connection with said drum. Alternatively, or in combination with the foregoing, the drum is connected with power means for causing rotation of the drum and screen at a sub-critical speed at which material present upon an internal screening surface of the screen will drop from that surface at least as the screen passes through the apex of its rotation.

In its most preferred embodiments, the drum of the apparatus will include means for discharging particulate material that has been reduced in the drum into the upstream portion of the screening member and means for receiving particulate material from within the downstream portion of the screening member. For example, the means for receiving particulate material may include one or more ports formed in a peripheral wall of said drum. According to another preferred aspect of the invention, the drum may be connected with power means for causing rotation of the drum and screen at a sub-critical speed at which material present upon an internal screening surface of the screen will drop from that surface at least as the screen passes through the apex of its rotation, and the means for receiving particulate material includes arcuate scoop members positioned for gathering material from the screening surface and connected with one or more ports formed in a peripheral wall of said drum for discharging material from said scoop members through said ports into the drum.

Any of the foregoing may be applied in combination with apparatus having the following features. The rotary drum particle size reduction means includes an upstream portion, including an upstream end, a downstream portion, including a downstream end, a longitudinal axis, and the substantially imperforate drum has a generally rounded cross-section, is arranged about said longitudinal axis between said upstream and downstream ends, includes means for introducing feed material comprising particulate solids into said drum, and includes means for confining within said drum reduction media for reducing the particle size of the particulate solids. The rotary screen has a longitudinal axis and the perforate screening member has a generally rounded cross-section, is arranged about the screening member longitudinal axis between said upstream and downstream ends, and has perforations that are of sufficient size and number, and that are positioned, for separating particulate solids by particle size into undersize and oversize fractions. The means for vibrating produces vibrational components in said screen for promoting discharge of such undersize fractions through said screen. The drum longitudinal axis need not necessarily coincide but preferably does coincide with the screening member longitudinal axis.

Included in the improvements constituting the invention are preferred embodiments wherein: the drum includes means for discharging particulate material that has been reduced in the drum into the upstream portion of the screening member; screen supporting means, independent of the drum, support the upstream portion of the screen; the means for vibrating is included in said screen supporting means; the entire screen surrounds at least a portion of the periphery of the drum; the downstream portion of the screen is both supported and rotated by a driving connection with the exterior of a peripheral wall of said drum; and the drum includes means for receiving particulate material from within the downstream portion of the screening member.

Figure 2:
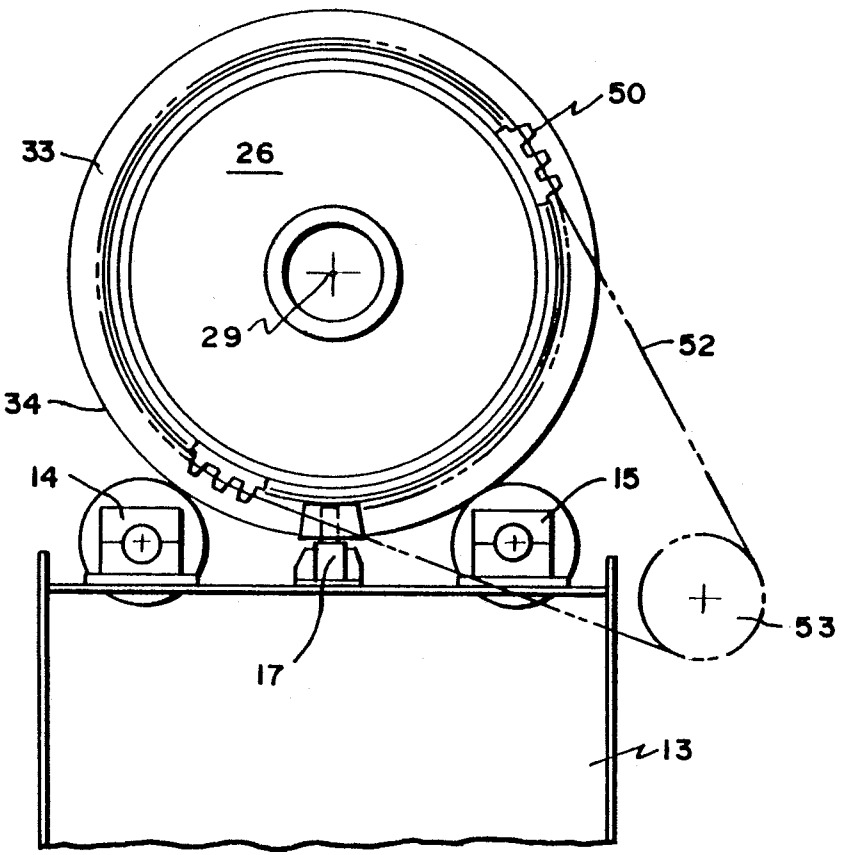
FIG. 2 is a cross-section, transverse to the longitudinal axis of the device, at section line 2—2 in FIG. 1, and shows supporting means for the drum of the particle size reduction means and, in phantom lines, power means for driving the drum, including fragments of a drum drive sprocket.

In the embodiment disclosed in FIGS. 1–3, rotary drum particle size reduction means 10 is supported by first drum supporting means 11 and second drum supporting means 19. Drum supporting means 11 comprises left foundation 13, main wheel assembly 14, main wheel assembly 15, thrust wheel assembly 16 and thrust wheel assembly 17. Second drum supporting means 19 comprises right foundation 20, a first main wheel assembly 21, and a second main wheel assembly (not shown).

Reduction means 10 comprises substantially imperforate drum 26 having an upstream portion 27, including an upstream end, a downstream portion 28, including a downstream end, and a longitudinal axis 29. Drum 26 is composed in part of cylindrical outer shell 30 within the ends of which are mounted spider plates 31 and 32 which internally support those portions of shell 30 on which exterior tires are mounted. Left and right tires 33 and 37 include peripheral surfaces 34 which respectively ride upon the wheels of the left and right drum supporting means 11 and 19, while left tire 33 has tapered sides 35 which engage thrust wheel assemblies 16 and 17.

Also included in drum 26 is an abrasion resistant liner 38, including the drum upstream end 39 (left), drum downstream end 40 (right) and a peripheral wall portion 41 which has a generally rounded cross-section, is arranged about the longitudinal axis between said upstream and downstream ends, and constitutes means for confining within said drum reduction media (not shown) for reducing the particle size of the particulate solids. Any suitable reduction media may be used, such as balls or rods, preferably the special rods disclosed and claimed in U.S. patent application Ser. No. 028,435, filed Mar. 20, 1987 by the present inventor, the disclosure of which is hereby incorporated by reference.

Drum upstream end 39 and drum downstream end 40 respectively include center openings 45 and 46. Mounted on chute support 47, inlet chute 48 constitutes means for introducing feed material (not shown) comprising particulate solids into the drum.

As best shown in FIG. 2, there is a power means for rotating the drum, which comprises drum sprocket 50, typically a double sprocket, in stationary safety shroud 51 and driven by drive chains 52 and drive sprockets 53 rotated by a gear drive and motor (not shown).

Downstream in the drum are means for discharging particulate material that has been reduced in the drum into the upstream portion of the screening member. Any appropriate means may be employed for this purpose, including one or more ports 55 formed in a peripheral wall of the drum.

Rotary screen 59 surrounds at least a portion of the periphery of the drum and has longitudinal axis 60. Preferably, the screening member longitudinal axis coincides with the drum longitudinal axis. The screen also includes an upstream portion 61 having an upstream end 62 and a downstream portion 63 having a downstream end 64. Particle separation on the basis of particle size is performed by a perforate screening member 65 which has a generally rounded cross-section, is arranged about the screening member longitudinal axis between said upstream and downstream ends, and has perforations that are of sufficient size and number, and that are positioned, for separating particulate solids by particle size into undersize and oversize fractions. This perforate member is mounted on a cylindrical screen supporting frame 66 including grid members 67. Means are included in the equipment for engaging and supporting (and thereby connected with) an upstream portion of the screen for vibrating its upstream portion substantially independent of the drum. In this particular case, as best seen in FIGS. 1 and 3, the screen supporting means 70 engages the screen at its upstream end and includes screen wheel support assemblies 72 and 73, respectively mounted on stands 74 and 75 atop exciter frame 76. Attached to the same frame are motor 77 with a drive shaft (not shown) and eccentric weights (not shown) within housings 80 and 81. Through isolation mounts 82, such as springs, rubber donuts, air bags or the like, exciter frame is supported on and connected to a step 83 on right foundation 20.

From the foregoing description and the drawings, it may be seen that this embodiment exemplifies a number of the improvements considered to be part of the present invention. For example, the means for vibrating is included in said screen supporting means, more specifically is connected with a wheel support for the screen, and still more specifically is included in said wheel support. Also, the upstream portion of the screen is spaced inwardly in the longitudinal direction from the corresponding end of the drum, screen supporting means independent of the drum engages the screen for supporting the upstream portion of the screen, and drum supporting means, separate from the screen supporting means, for supporting said corresponding end of the drum, is spaced outwardly in the longitudinal direction from the corresponding end of the screen. Moreover, the length of the screen is less than the length of the drum, and at least the upstream portion of the screen is spaced inwardly in the longitudinal direction from the corresponding end of the drum.

The means for vibrating produces vibrational components in said screen for promoting discharge of such undersize fractions through said screen. Preferably the means for vibrating predominantly produces in said screen vibrational components in directions transverse to the axis of rotation of the screen, and preferably in a vertical plane. A frequency of for example about 50 to about 3,000, more typically about 90 to about 2800 and still more typically about 100 to about 2500 cycles per minute may be used. An amplitude of for example about 1/32 to about $\frac{3}{8}$, more typically about 1/16 to about 5/16 and still more typically about $\frac{1}{8}$ to about $\frac{1}{4}$ inch may be used. When selecting frequency and amplitude, it is considered best from the standpoint of controlling maintenance costs to select a relatively low amplitude when using a relatively high frequency and vice versa. Currently, although higher frequencies, e.g. about 1500 to about 2500 cycles per minute, can produce more throughput per unit time, it is considered most cost-effective to operate with a frequency in the range of about 80 to about 900 cycles per minute. In this connection it is recommended that the power applied through the vibratory exciter be limited to the minimum amount required to adequately counter-act blinding of the screen. However, persons skilled in the art should in any event, with the aid of this disclosure, be able to establish various combinations of appropriate frequencies and amplitudes without undue experimentation. The preferred vibratory exciters are among those heretofore typically used in vibrating screens, bin dischargers and the like. These may for example be selected to emphasize amplitude of vibration while de-emphasizing frequency, which has been found to work best with coal wastes. However, exciters which emphasize frequency of vibration while deemphasizing amplitude are particularly preferred. This mode of operation has been found to work best with some forms of limestone, and encourages retention of contact between the wheels of screen support assemblies 72, 73 and a tire 94 which is mounted on the screen frame and rides on these wheels. Additional means such as a sidewardly projecting ring flange (not shown) on tire 94 and hold-down rollers (not shown) engaging said flange may also be used to encourage retention of contact between the wheels and tire.

In addition to tire 94, screen frame 66 has at its upstream end a joint 93, which may be a labyrinth seal, flexible skirt type seal or other form of joint, by means of which upstream portion of the screen is effectively vibrationally isolated from the portion of the drum surrounded thereby, while also serving as means to confine the screen contents at that end of the screen.

In the embodiment of FIGS. 1–3, the screen downstream portion surrounds at least a portion of the periphery of the drum. More particularly, the entire screen, including the downstream end thereof, surrounds at least a portion of the periphery of the drum. The screen downstream end 64 is connected to the exterior peripheral surface of the drum by any suitable damped connection such as a spring loaded connection, resilient joint or other damping means. This embodiment utilizes a resilient joint 99 including resilient packing 101 compressed between a circular flange 100 on frame 66 and circular flange 105 on end assembly 102, which supports the latter flange through cylindrical portion 104 and annular disk 103. While the upstream and mid portion of the screen vibrates in the manner shown by the arrows in FIG. 1, the amplitude of the vibration gradually decreases along the length of the screen in the downstream direction, and reaches a minimum and preferably substantially zero at joint 99. Joint 99 and end assembly 102 provide the downstream portion of the screen with a driving connection to the exterior of the peripheral wall of the drum for causing rotation of the screen as the drum rotates, both supporting and driving the downstream portion of the screen through its connection with said drum.

This embodiment of the apparatus not only includes the above-described means for discharging particulate material that has been reduced in the drum into the upstream portion of the screening member, but also includes means for receiving particulate material from within the downstream portion of the screening member. In this embodiment, the receiving means, located at 106 in FIG. 1, includes an external flange 107 and one or more ports 108 formed in the peripheral wall of the drum. Arcuate scoop members 109 are positioned at 106 (FIG. 1) in the manner shown in FIG. 3 for gathering material from the screening surface and are connected with the port or ports 108 for discharging material from said scoop members through said port(s) into the drum. In order that scoop members 109 may discharge material through port(s) 108 into the drum, the power means is selected, arranged and adjusted for causing rotation of the drum and screen at a sub-critical speed at which material present upon an internal screening surface of the screen will drop from that surface at least as the screen passes through the apex of its rotation. Examples of appropriate screening member inside diameters and corresponding RPM values are 20 RPM for a diameter of 8.5 feet and 27 RPM for a diameter of 5 feet.

Typically, at least the screen will be surrounded by a housing 110, indicated in dotted lines, having a hopper section 112 and, at its bottom end, a hopper outlet 113 to discharge screened material.

Another embodiment of the present invention is disclosed in FIGS. 4–9. In this embodiment rotary drum particle size reduction means 123 is supported by first supporting means 124 and second drum supporting means 132. First drum supporting means 124 comprises common frame 229, main wheel assembly 127, main wheel assembly 128, thrust wheel assembly 129 and thrust wheel assembly 130. Second drum supporting means 132 comprises common frame 229, a first main wheel assembly 185, and a second main wheel assembly 186, mounted on bearing blocks 187 and 188 respectively.

Reduction means 123 comprises substantially imperforate drum 139 having an upstream portion 140, including an upstream end, a downstream portion 141, including a downstream end, and a longitudinal axis 142. Drum 139 is composed in part of cylindrical outer shell 143 within the ends of which are mounted spider plates 144 and 145 which internally support those portions of shell 143 on which tires are mounted. Left and right tires 146 and 150 include peripheral surfaces 147,149 which respectively ride upon the wheels of the left and right drum supporting means 124 and 132. Left tire 146 has tapered sides 148 which engage thrust wheel assemblies 129 and 130.

Also included in drum 139 is a peripheral wall portion 154, which has a generally rounded cross-section and is arranged about the drum longitudinal axis between its upstream and downstream ends. Wall portion 154 encloses an abrasion resistant liner including a peripheral portion 151, as well as drum upstream end 152 (left) and drum downstream end 153 (right). The liner constitutes means for confining within the drum a plurality of rods 155 which serve as reduction media for reducing the particle size of the particulate solids. As disclosed above, any suitable reduction media may be used, such as balls or rods, and preferably the media disclosed and claimed in U.S. patent application Ser. No. 028,435, referred to above, filed Mar. 20, 1987 by the present inventor.

Figure 6:
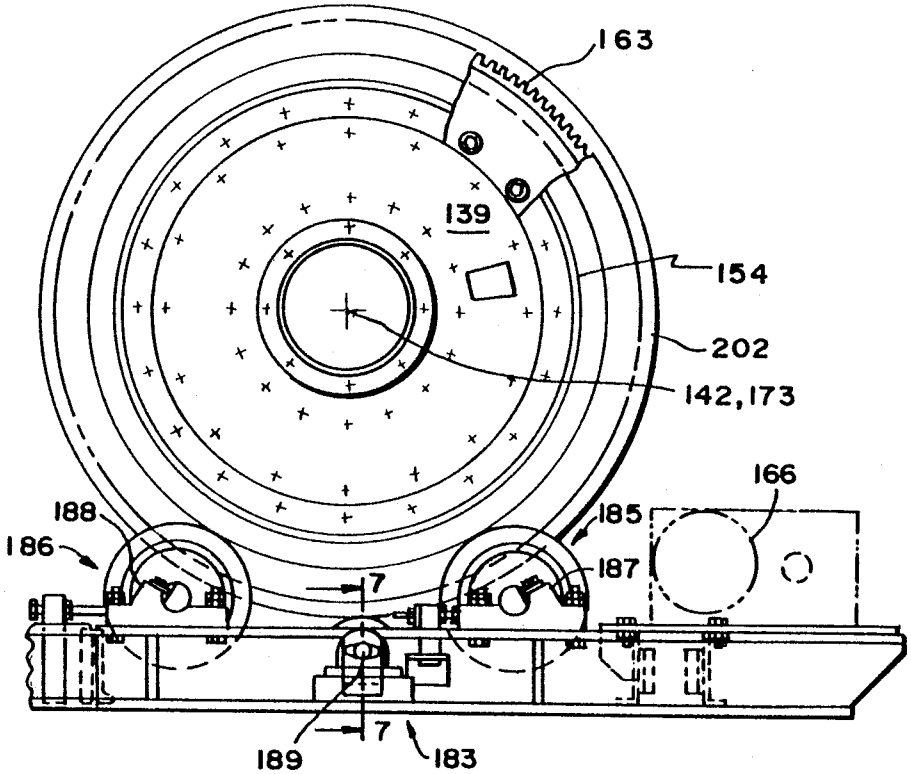
FIG. 6 is a cross-section, taken transverse to the longitudinal axis of the mill screen at section line 6—6 of FIG. 4.
Figure 5:
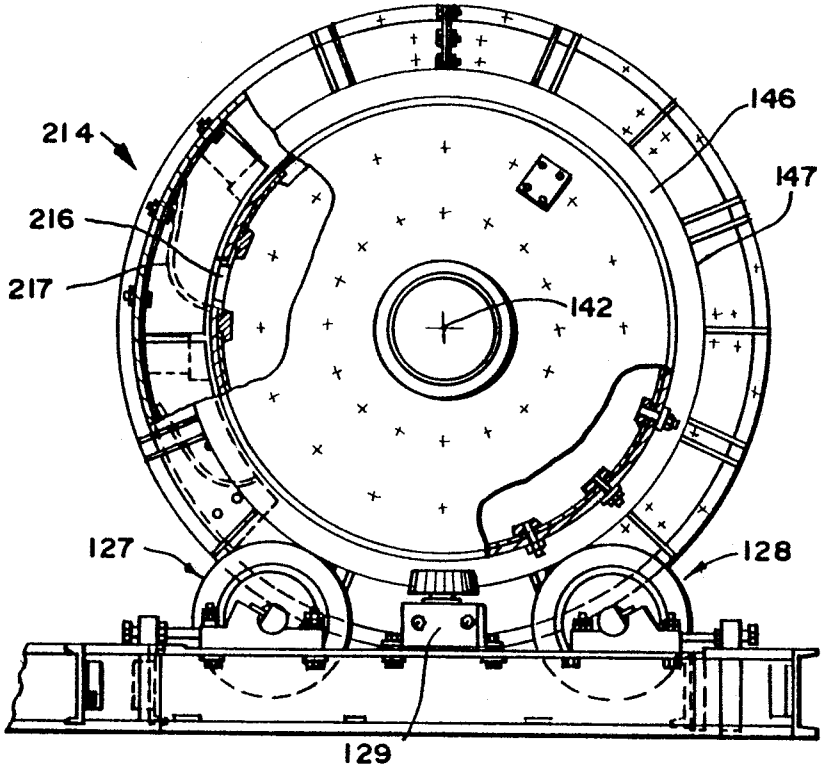
FIG. 5 is a cross-section, taken transverse to the longitudinal axis of the mill screen at section line 5—5 of FIG. 4.

Drum upstream end 152 and drum downstream end 153 respectively include center openings 158 and 159. A chute support and inlet chute mounted thereon (not shown) constitute means for introducing feed material (not shown) comprising particulate solids into opening 158. As best shown in FIG. 6, drum sprocket 163, which is typically a double sprocket mounted in a stationary safety shroud (not shown) and is driven by drive chains (not shown), acts with drive sprockets 166 rotated by a gear drive and motor (not shown) as power means for rotating the drum and tumbling a bed of said solids and grinding media in the drum, thereby causing reduction of the solids.

Downstream in the drum are means for discharging particulate material that has been reduced in the drum into the upstream portion of the screening member. Any appropriate means may be employed for this purpose, including one or more ports 168 (FIG. 4) formed in a peripheral wall of the drum.

Rotary screen 172 surrounds at least a portion of the periphery of the drum and has longitudinal axis 173 preferably coinciding with the drum longitudinal axis. The screen also includes an upstream portion 174 having an upstream end 175 and a downstream portion 176 having a downstream end 177. Particle separation on the basis of particle size is performed by a perforate screening member 178 which has a generally rounded cross-section, is arranged about the screening member longitudinal axis between said upstream and downstream ends, and has perforations that are of sufficient size and number, and that are positioned, for separating particulate solids by particle size into undersize and oversize fractions. This perforate member is mounted on a cylindrical screen supporting frame 179 including grid members 180.

Figure 4:
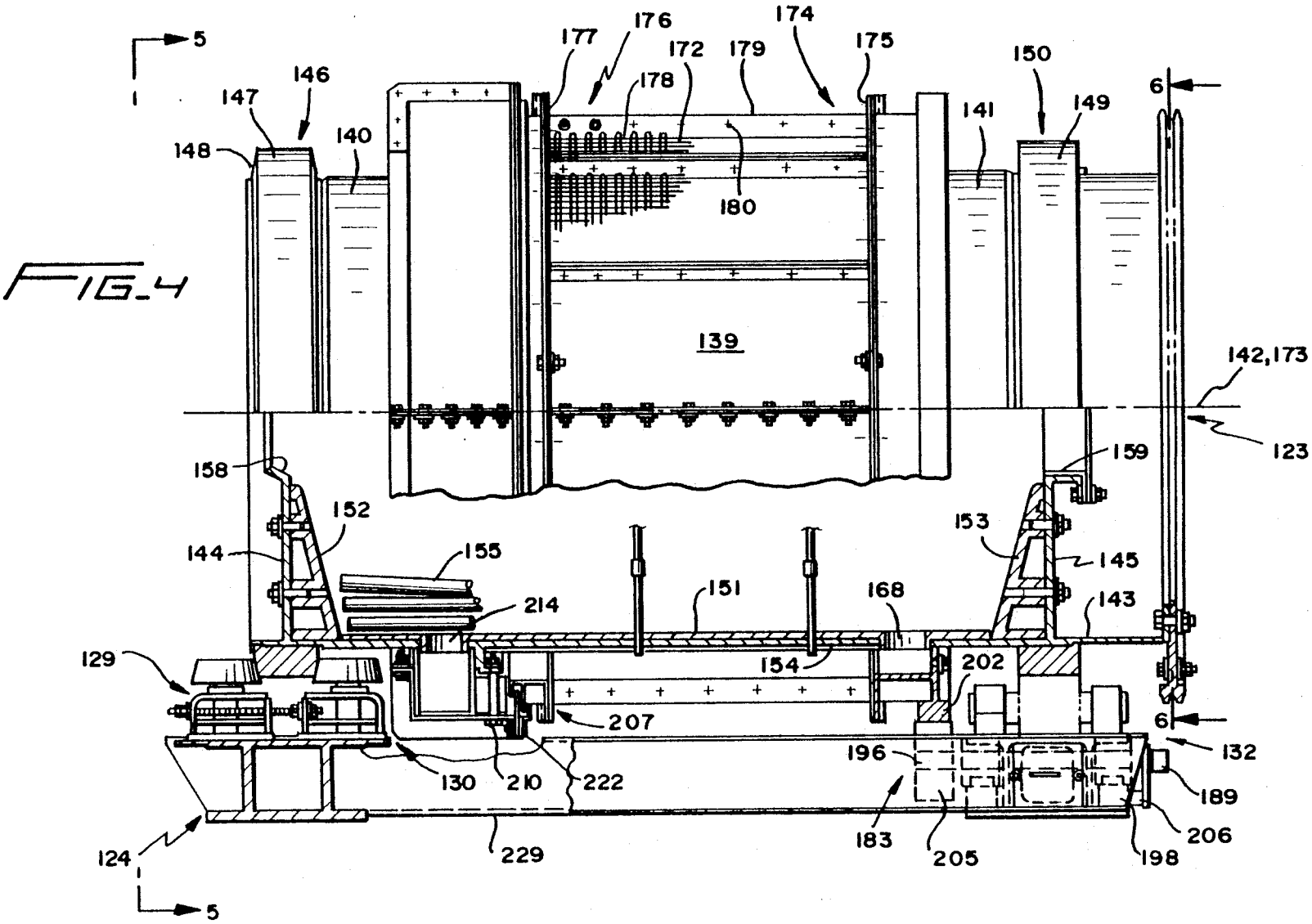
FIG. 4 is an elevational view of another embodiment of a mill screen in accordance with the invention.

Means are included in the equipment for engaging and supporting (and thereby connected with) an upstream portion of the screen for vibrating its upstream portion substantially independent of the drum. In this particular case, as best seen in FIGS. 4 and 6, the screen supporting means 183 engages the screen at its upstream end and includes wheel 205 for supporting tire 202.

As shown in FIGS. 7 and 8, wheel 205 is provided with inner and outer caps 204,203, and is secured by eccentric sleeve 228 for eccentric rotation on shaft 196. Keyway 192 secures sleeve 228 to shaft 196. Bearings 200 are provided for supporting wheel 205 at the outer end of shaft 196. Shaft 196 is also supported by bearing blocks 197 and driven by hydraulic motor 189 which is supported on housing assembly 198 by bracket 206. In the cross-section of eccentric sleeve 228 shown in FIG. 8, reference lines 193 and 194 pass through the central axes of the cylindrical internal and external sleeve surfaces. The distance between lines 193 and 194 is a measure of the eccentricity of sleeve 228 which establishes the amplitude of the eccentricity of the rotation of wheel 205 and of the resultant vibrations induced in the screen through tire 202.

In the embodiment of FIGS. 4–9, the screen downstream portion surrounds at least a portion of the periphery of the drum. More preferably, the entire screen, including the downstream end thereof, surrounds at least a portion of the periphery of the drum. The screen downstream end 177 is connected to the exterior peripheral surface of the drum by any suitable damped connection such as a spring loaded connection, resilient joint or other damping means. As shown in enlarged detail in FIG. 9, a preferred resilient joint 207 includes flexible packing 223 and rubber trommel seat 225 which are compressed between a trommel seal ring 224 and trommel mount 222. The upstream and mid portion of the screen vibrates as depicted in FIG. 1, the amplitude of the vibration gradually decreasing along the length of the screen in the downstream direction, and reaches a minimum and preferably substantially zero at joint 207. Joint 207 and end assembly 210 (FIG. 4) provide the downstream portion of the screen with a driving connection to the exterior of the peripheral wall of the drum for causing rotation of the screen as the drum rotates, both supporting and driving the downstream portion of the screen through its connection with said drum.

This embodiment of the apparatus not only includes the above-described means for discharging particulate material that has been reduced in the drum into the upstream portion of the screening member, but also includes means for receiving particulate material from within the downstream portion of the screening member. In this embodiment, the receiving means, located at 214 in FIGS. 4 and 5, includes one or more ports 216 formed in the peripheral wall of the drum. Arcuate scoop members 217 are positioned in the manner shown in FIG. 5 for gathering material from the screening surface and are connected with the port or ports 216 for discharging material from said scoop members through said port(s) into the drum. In order that scoop members 217 may discharge material through port(s) 216 into the drum, the power means is selected, arranged and adjusted for causing rotation of the drum and screen at a sub-critical speed at which material present upon an internal screening surface of the screen will drop from that surface at least as the screen passes through the apex of its rotation. Examples of appropriate screening member inside diameters and corresponding RPM values are 20 RPM for a diameter of 8.5 feet and 27 RPM for a diameter of 5 feet.

Typically, at least the screen will be surrounded by a housing having a hopper section and, at its bottom end, a hopper outlet (not shown) to discharge screened material.

The foregoing embodiments can be modified in a wide variety of ways without departing from the spirit of the invention. Thus, these embodiments are merely illustrative and are by no means intended to limit the invention, which is to be construed as including all subject matter within the literal scope of the following claims and all equivalents thereof.

I claim:

1. Co-rotating screen and reduction drum apparatus for reducing particulate materials, comprising:

(a) rotary drum particle size reduction means having a substantially imperforate drum, (b) a rotary screen connected with said drum for co-rotation therewith, and having a perforate screening member with upstream and downstream portions, including upstream and downstream ends, said upstream portion of the screen surrounding at least a portion of the periphery of the drum, and (c) means engaging an upstream portion of said screen and including a vibratory exciter for vibrating said upstream portion substantially independent of the drum, for restricting consumption of power that would otherwise be expended in vibrating the drum while promoting increased removal of fines from the particulate material through the upstream portion of the screening member.

2. Apparatus according to claim 1 wherein the drum includes means for discharging particulate material that has been reduced in the drum into the upstream portion of the screening member.

3. Apparatus according to claim 2 wherein the means for discharging particulate material includes at least one port formed in a peripheral wall of said drum.

4. Apparatus according to claim 1 wherein the means engaging the upstream portion of said screen for vibrating said upstream portion substantially independent of the drum is effectively vibrationally isolated from the portion of the drum surrounded thereby.

5. Apparatus according to claim wherein the means for vibrating predominantly produces in said screen vibrational components in directions transverse to the axis of rotation of the screen.

6. Apparatus according to claim 1 wherein the upstream portion of the screening member is spaced inwardly in the longitudinal direction from one end of the drum, screen supporting means independent of the drum engages the screening member for supporting the upstream portion of the screening member, and drum supporting means, separate from the screen supporting means, for supporting said one end of the drum, is spaced outwardly in the longitudinal direction from the screen supporting means.

7. Apparatus according to claim 1 including screen supporting means independent of the drum which engages the screen for supporting the upstream portion of the screen, and wherein the means for vibrating is included in said screen supporting means.

8. Apparatus according to claim 7 wherein the screen supporting means includes a tire on the upstream portion of the screen, wheels supportingly engaging said tire, and a wheel support for said wheels, and the means for vibrating is connected with said wheel support.

9. Apparatus according to claim 8 wherein the vibratory exciter produces vibrations of sufficient frequency and sufficiently limited amplitude and power for retaining contact between the wheels and tire while counteracting blinding of the screening member.

10. Apparatus according to claim 7 wherein the screen supporting means includes a tire on the upstream portion of the screen, wheels engaging said tire, a wheel support for said wheels, and wherein the means for vibrating is included in said wheel support.

11. Apparatus according to claim 10 wherein the vibratory exciter produces vibrations of sufficient frequency and sufficiently limited amplitude and power for retaining contact between the wheels and tire while counteracting blinding of the screening member.

12. Apparatus according to claim 7 wherein the screen supporting means engages the screen at its upstream end.

13. Apparatus according to claim 7 wherein the upstream portion of the screen is spaced inwardly in the longitudinal direction from the corresponding end of the drum, screen supporting means independent of the drum engages the screen for supporting the upstream portion of the screen, and drum supporting means, separate from the screen supporting means, for supporting said corresponding end of the drum is spaced outwardly in the longitudinal direction from the corresponding end of the screen.

14. Apparatus according to claim 1 wherein the length of the screen is less than the length of the drum, and at least the upstream portion of the screen is spaced inwardly in the longitudinal direction from the corresponding end of the drum.

15. Apparatus according to claim 1 wherein the downstream portion of the screen surrounds at least a portion of the periphery of the drum.

16. Apparatus according to claim 1 wherein the entire screen surrounds at least a portion of the periphery of the drum.

17. Apparatus according to claim 1 wherein the downstream portion of the screen has a driving connection with the exterior of a peripheral wall of said drum for causing rotation of the screen as the drum rotates.

18. Apparatus according to claim 17 wherein the downstream portion of the screen is both supported and driven by its connection with said drum.

19. Apparatus according to claim 18 wherein the drum includes means for discharging particulate material that has been reduced in the drum into the upstream portion of the screening member and means for receiving particulate material from within the downstream portion of the screening member.

20. Apparatus according to claim 19 wherein the means for receiving particulate material includes at least one port formed in a peripheral wall of said drum.

21. Apparatus according to claim 19 wherein the drum is connected with power means for causing rotation of the drum and screen at a sub-critical speed at which material present upon an internal screening surface of the screen will drop from that surface at least as the screen passes through the apex of its rotation, and the means for receiving particulate material includes arcuate scoop members positioned for gathering material from the screening surface and connected with at least one port formed in a peripheral wall of said drum for discharging material from said scoop members through said at least one port into the drum.

22. Apparatus according to claim 17 wherein the drum is connected with power means for causing rotation of the drum and screen at a sub-critical speed at which material present upon an internal screening surface of the screen will drop from that surface at least as the screen passes through the apex of its rotation.

23. Apparatus according to claim 1 wherein:

(a) said rotary drum particle size reduction means includes:
  (1) an upstream portion, including an upstream end,
  (2) a downstream portion, including a downstream end,
  (3) a longitudinal axis, and
(b) said substantially imperforate drum
  (1) has a generally rounded cross-section,
  (2) is arranged about said longitudinal axis between said upstream and downstream ends,
  (3) includes means for introducing feed material comprising particulate solids into said drum, and
  (4) includes means for confining within said drum reduction media for reducing the particle size of the particulate solids;
(c) said rotary screen has a longitudinal axis;
(d) said perforate screening member
  (1) has a generally rounded cross-section,
  (2) is arranged about the screening member longitudinal axis between said upstream and downstream ends, and
  (3) has perforations that are of sufficient size and number, and that are positioned, for separating particulate solids by particle size into undersize and oversize fractions; and
(e) the means for vibrating produces vibrational components in said screen for promoting discharge of such undersize fractions through said screen.

24. Apparatus according to claim 23 wherein the drum longitudinal axis coincides with the screening member longitudinal axis.

25. Apparatus according to claim 23 wherein (a) the drum includes means for discharging particulate material that has been reduced in the drum into the upstream portion of the screening member, (b) screen supporting means, independent of the drum, support the upstream portion of the screen, (c) the means for vibrating is included in said screen supporting means, (d) the entire screen surrounds at least a portion of the periphery of the drum, (e) the downstream portion of the screen is both supported and rotated by a driving connection with the exterior of a peripheral wall of said drum, and (f) the drum includes means for receiving particulate material from within the downstream portion of the screening member.

* * * * *